US006473930B1

(12) United States Patent
Ortega

(10) Patent No.: US 6,473,930 B1
(45) Date of Patent: Nov. 5, 2002

(54) ROTARY FEEDING NIPPLE SCRUB

(76) Inventor: Alberto F. Ortega, 4878 Montague Ave., Fremont, CA (US) 94555

( * ) Notice: Subject to any disclaimer, the term of this patent is extended or adjusted under 35 U.S.C. 154(b) by 10 days.

(21) Appl. No.: 09/884,347

(22) Filed: Jun. 18, 2001

(51) Int. Cl.[7] ..... A47L 25/00

(52) U.S. Cl. ..... 15/211; 15/118; 15/164; 15/147.1; 15/244.1

(58) Field of Search ..... 15/65, 101, 118, 15/164, 147.1, 211, 244.1

(56) References Cited

U.S. PATENT DOCUMENTS

| | | | | | |
|---|---|---|---|---|---|
| 1,801,118 | A | * | 1/1931 | Smith | 15/244.1 |
| 2,357,446 | A | * | 9/1944 | Bendar | 15/244.1 |
| 2,792,579 | A | * | 5/1957 | Roy | 16/164 X |
| 3,409,926 | A | * | 11/1968 | Martin | 15/211 X |
| 3,862,461 | A | | 1/1975 | Bucklitzsch | 15/164 |
| D333,368 | S | | 2/1993 | Flowers | D32/40 |
| 5,214,820 | A | * | 6/1993 | Shumway et al. | 15/118 |
| D337,659 | S | | 7/1993 | Lacy | D4/116 |
| D356,443 | S | | 3/1995 | Willis | D4/116 |
| 5,513,410 | A | | 5/1996 | Liu | 15/106 |
| 5,621,941 | A | | 4/1997 | Liu | 15/106 |
| 5,709,003 | A | | 1/1998 | Batch | 15/106 |
| D434,540 | S | | 11/2000 | Katsukawa | D32/42 |
| 6,146,040 | A | | 11/2000 | Dunn et al. | 401/138 |
| D435,155 | S | | 12/2000 | Katsukawa | D32/42 |

FOREIGN PATENT DOCUMENTS

| | | | | |
|---|---|---|---|---|
| CA | 2060166 | * | 8/1992 | 15/164 |

* cited by examiner

*Primary Examiner*—Mark Spisich
(74) *Attorney, Agent, or Firm*—Thomas Schneck; Gina McCarthy

(57) ABSTRACT

A scrubber for cleaning a baby bottle nipple is comprised of a handle and a rod rotatably and removably attached to said handle. The rod is attached to a clip having tangs, removably attached to each other and securing a conical scrubbing material therebetween. The tangs and the scrubbing material are received within a baby bottle nipple for scrub cleaning the baby bottle nipple as the handle of the scrubber apparatus is rotated.

20 Claims, 4 Drawing Sheets

ROTARY FEEDING NIPPLE SCRUB

FIELD OF THE INVENTION

The present invention relates to a nipple scrub having a rotatable handle attached to a rotatable rod with a clip securing a scrubbing material therebetween to achieve thorough cleaning of a baby bottle nipple.

BACKGROUND OF THE INVENTION

The importance of having clean bottle nipples used with baby bottles for feeding young children is well recognized. A dirty baby bottle nipple can result in serious health consequences for the baby drinking therefrom.

There has long been in use brush cleaners for cleaning baby bottles. Hot water and soap or other cleaning agents used with a brush are used to clean baby bottles. Although such brushes may clean the bottle reasonably well, they are not designed to, nor do they clean baby bottle nipples thoroughly.

For example, U.S. Pat. No. 3,862,461 issued to Bucklitzsch has an outwardly tapered bottom that is designed to enable the brush to reach the lower corners of the bottle. Though such a brush may be able to reach lower corners of the bottle, it would not be able to effectively clean the inner areas of a bottle nipple as the outwardly tapered bottom would not fit within a bottle nipple.

U.S. Pat. No. 5,621,941 to Liu describes a baby bottle cleaner having dual brushes. The main brush is bent to generally conform to the shape of the baby bottle. The second brush or rod holds the main brush against the surface of the bottle. This apparatus would not be thorough in cleaning a baby bottle nipple as it's shape does not allow it to clean all areas of the nipple including the narrow top portion and wider bottom portion of the nipple. Additionally, the second brush which holds the main brush against the surface of the bottle does not provide any additional support or force to the main brush that would assist in cleaning.

A dishwasher using hot water and detergent may also be used to clean baby bottles and baby bottle nipples. Again, the washer may clean baby bottles reasonably well. However, dishwashers tend to be ill-suited for cleaning baby bottle nipples. Dried milk or baby formula accumulates on the inner part of the nipple.

It is difficult for the dishwasher to penetrate the inner nipple to clean the dried material.

Therefore, it is an object of the invention to provide an apparatus for cleaning baby bottle nipples and the like that is capable of thoroughly cleaning the inner part of the nipple.

It is a further object of the invention to provide an apparatus for cleaning baby bottle nipples that is simple and relatively inexpensive to manufacture.

It is another object of the invention to provide an apparatus for cleaning baby bottle nipples that is easy to assemble and disassemble.

SUMMARY OF THE INVENTION

The present invention provides a hand operated apparatus for cleaning baby bottle nipples or the like, capable of effectively and efficiently cleaning the entire inside surface of a baby bottle nipple.

The nipple scrub is comprised of a handle with a rod having an offset, the rod rotatably attached to the handle at one end. A clip is attached at a distal end of the rod. A scrubbing material such as a sponge is secured between two tangs of the clip.

The distal end of the rod terminates in a flat surface. In one embodiment the flat surface is a disk. The disk is attached to one of the two tangs making up the clip. The disk provides a support for the scrubbing material and provides pressure to the scrubbing material allowing the scrubbing material to be compressed into the nipple thus assisting in the thorough cleaning of the nipple.

In operation, the clip and the scrubbing material secured therebetween are received by the nipple. The user wets the scrubbing material with cleaning fluid and cleans the nipple. The apparatus is then rotated by grasping the nipple in one hand to hold it steady, while grasping the handle in the other hand and rotating the handle. The conical shape of the scrubbing material and the tangs, which converge to an apex, assist in enabling the apparatus to reach all parts of the baby bottle nipple for cleaning as the nipple scrub is rotated.

The parts of the nipple scrub apparatus are removably secured to one another and provide for easy assembly. The bottom of the rod is "snap fit" into place with a cavity of the handle. One tang of the clip is "snap fit" into place with the other tang of the clip. These removable parts can be manufactured easily using an injection molding process. The scrubbing material has an opening allowing it to be secured within the clip and easily removed and replaced.

DETAILED DESCRIPTION OF THE INVENTION

Figure 1:
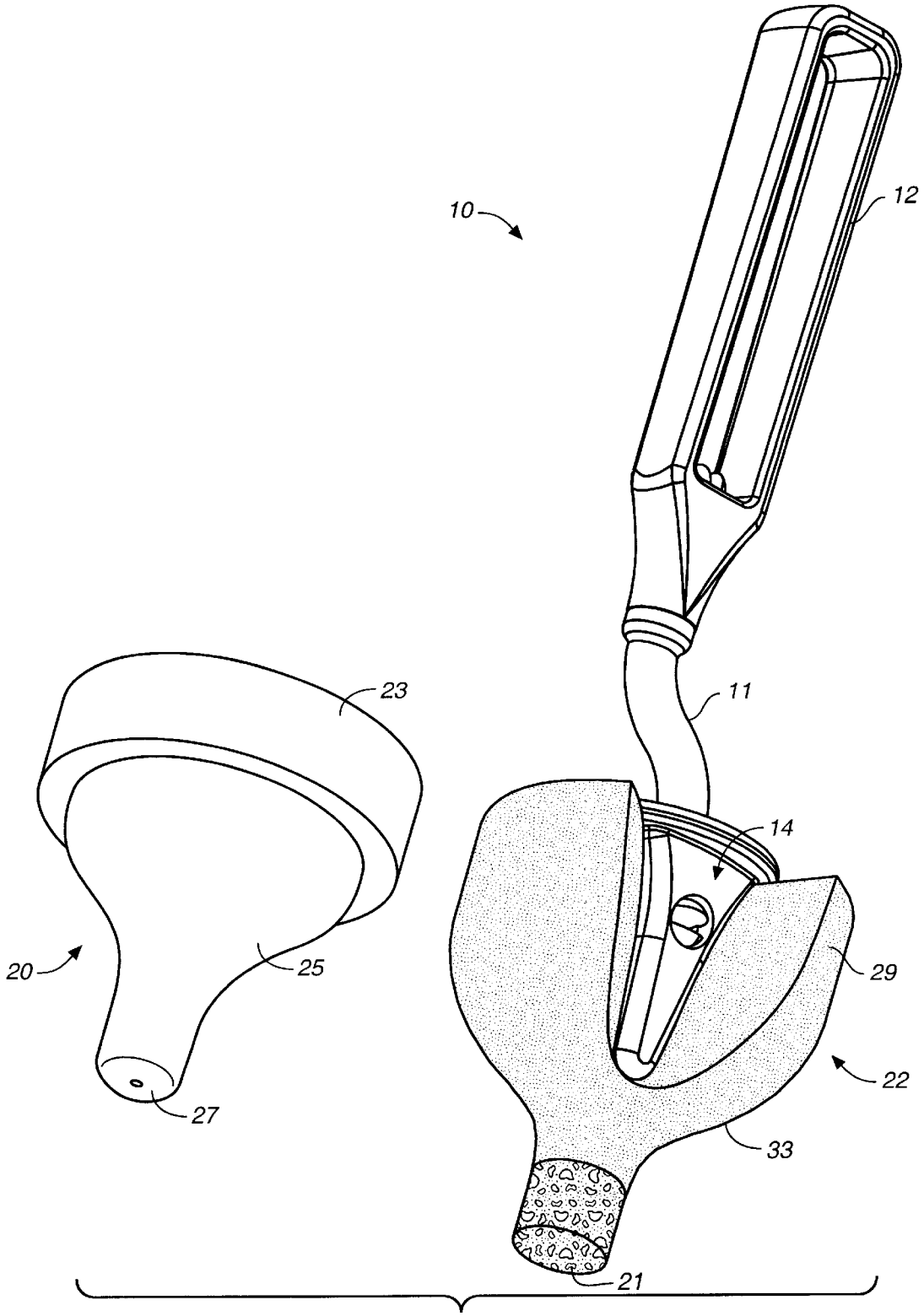
FIG. 1 is a perspective view of the apparatus of the present invention in conjunction with a bottle nipple.

Referring to FIG. 1 there is seen the nipple scrub apparatus 10 of the present invention. The nipple scrub is comprised of a rod 11 having an offset. The rod has curvature or is S-like in shape as shown in FIG. 1. The rod 11 is rotatably attached to handle 12 at one end. At a distal end the rod has a clip 14. A scrubbing material 22 is secured between the clip 14.

The scrubbing material 22 including tip 21 is for example, comprised completely of a sponge or a sponge-like material 33 or other material. Alternatively, a tip 21 of the scrubbing material 22 is for example, an abrasive scrubbing material. The scrubbing material 22 cleans even difficult to remove material such as caked on dry milk. A sponge or sponge-like scrubbing material is shaped by a die cutter press known in the art.

The apparatus 10 is used for cleaning a baby bottle nipple 20, or the like. The nipple 20 includes for example, an upper portion 25 and a tip 27 which a baby uses to draw liquid through and a lower portion 23 comprising for example, a hard plastic rim for attaching to a baby bottle (not shown).

Figure 2:
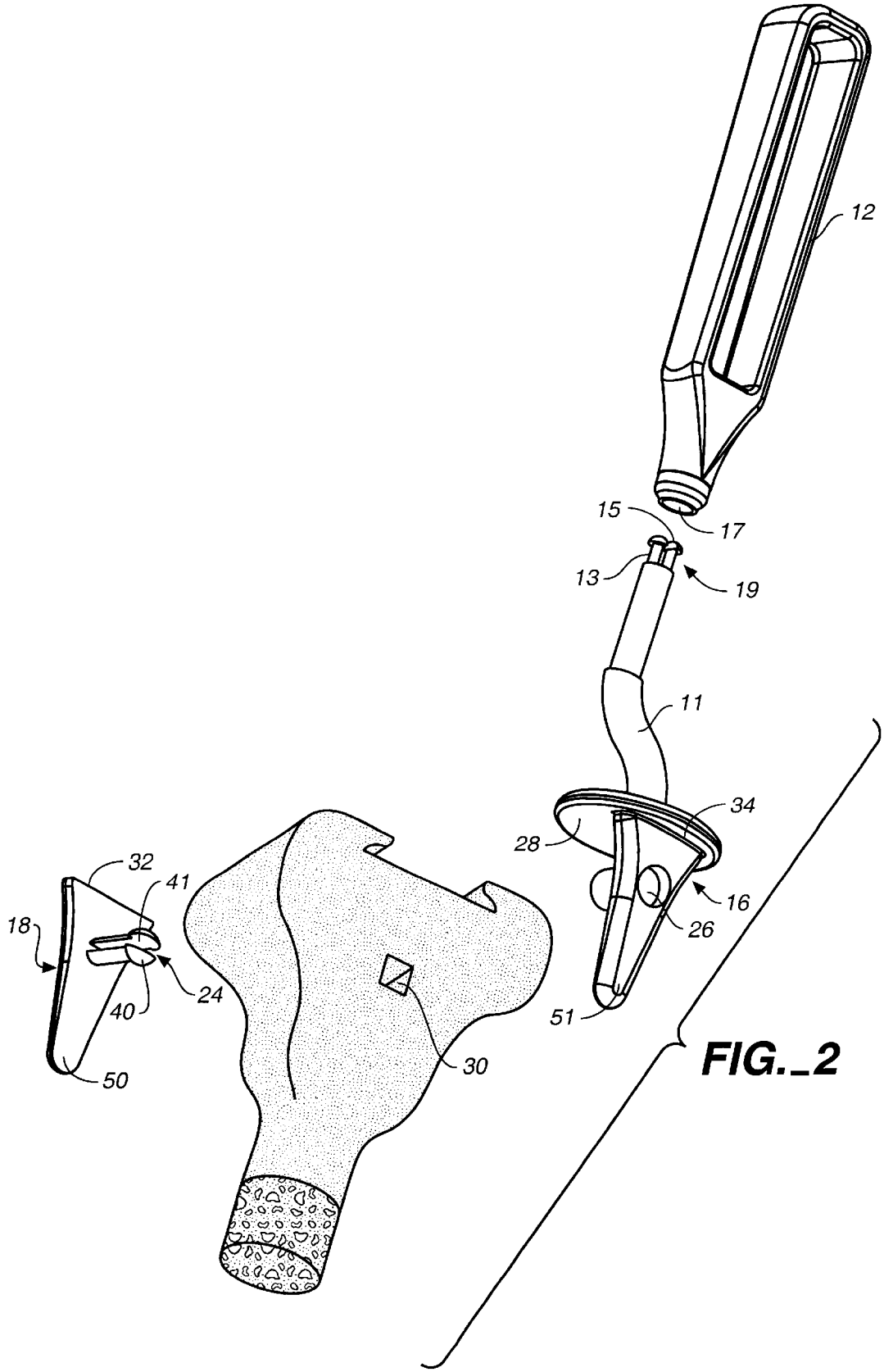
FIG. 2 is an exploded view of the invention of FIG. 1.

Referring to FIG. 2 it is seen that the rod 11 terminates in a flat surface, such as disk 28 at a distal end and that the clip 14 includes first and second tangs 16 and 18. The tangs 16 and 18 each have a base 34 and 32, respectively and each converge to an apex 51 and 50, respectively. The tangs are for example, triangular-like in shape. Tang 16 is attached to disk 28 through tang base 34. Tang 16 has a cavity 26 and tang 18 has a protrusion 24. In this example the protrusion 24 comprises two smaller tangs 40 and 41. The protrusion 24 is friction "snap fit" within the cavity 26. Other types of snaps may be used and the positions of the cavity and the protrusion are found on the reverse tangs in other examples.

Before the protrusion 24 is friction "snap fit" within the cavity 26 the scrubbing material 22 is secured within the clip 14. The scrubbing material 22 includes an opening 30. The opening 30 aligns with the cavity 26 and the protrusion 24 is placed through the opening 30 and the cavity 26 as it is secured or "snap fit" into place.

It is also seen in FIG. 2 that the rod 11 has at a proximal end a protrusion 19. Protrusion 19 is for example, tangs 13 and 15. These tangs friction "snap fit" into place with a cavity 17 in the handle 12.

The clip 14, the handle 12, and the rod 11 including disk 28 are for example made from a plastic material with an injection molding process known in the art.

Figure 3:
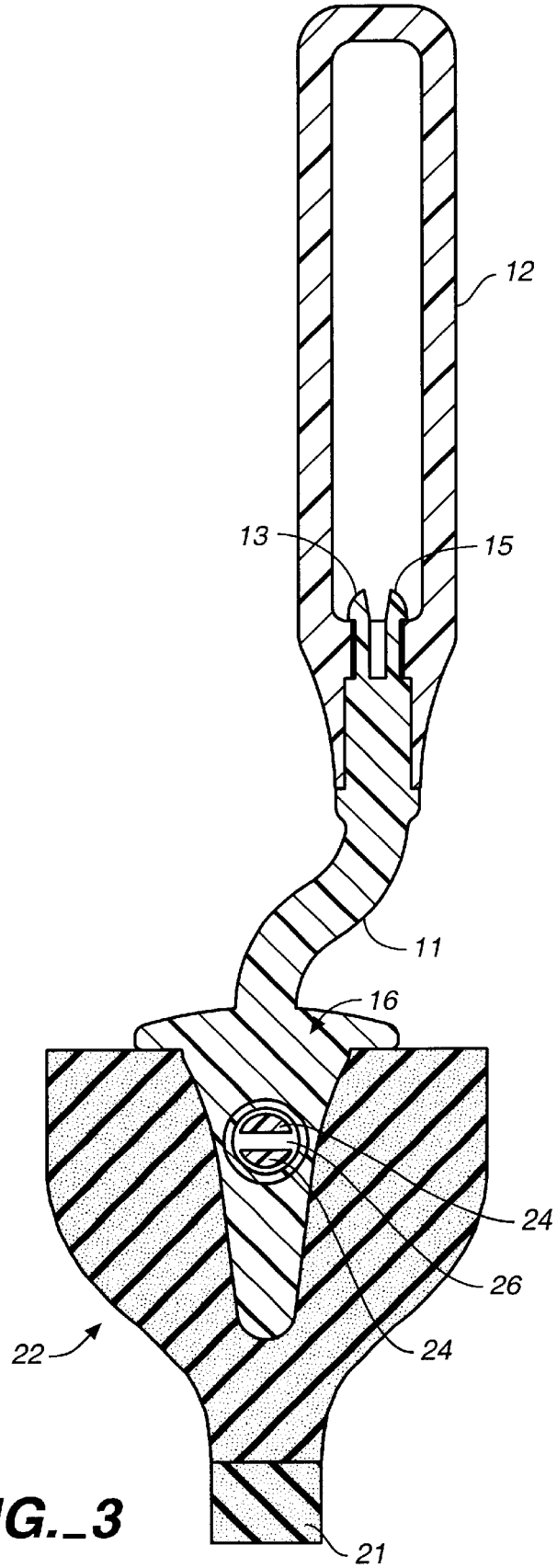
FIG. 3 is a cross-sectional view of the invention of FIG. 1.

Parts of the apparatus 10 are removably secured to one another for easy assembly. A tang of the clip 14 is removably secured to the other tang. The scrubbing material 22 is removably secured in between tangs 18 and 16. Additionally, the rod 11 is removably secured to the handle 12. These removable parts make for easy cleaning of the apparatus and for easy replacement of the materials, such as the scrubbing material 22. It is important to keep the removable parts clean as this ensures that the baby bottle nipple will not become contaminated by the apparatus. The assembled apparatus 10 is seen in FIG. 3.

In operation, a user assembles the apparatus 10 by attaching the rod 11 to the handle 12 and placing the scrubbing material 22 in between the tangs 16 and 18. The scrubbing material 22 is secured between the tangs of the clip 14. The opening of the scrubbing material 30 aligns with the cavity 26 of the tang 16 and the protrusion 24 of the tang 18 is inserted through the opening 30 and the tang cavity 26.

Before or after securing the scrubbing material 22 within the clip, the user wets the scrubbing material with for example a cleaning fluid or water and detergent.

The user inserts the apparatus into the nipple 20 such that the scrubbing material 22 and the clip 14 is received by the nipple 20. The user grasps the handle 12 and rotates the handle 12 thereby effecting rotation of the rod 11. The rotating rod 11 effects rotation of the attached clip 14 thereby causing rotation of the secured scrubbing material 22. Therefore, as the handle 12 and the rod 11 rotate within the nipple 20, the nipple 20 is cleaned by the rotating scrubbing material 22.

The disk 28 supports the scrubbing material 22 and as the user rotates the handle 12 the user also applies a force in the direction indicated by the arrow labeled F (seen in FIG. 4) towards the disk 28 thereby effecting the disk to apply pressure to the scrubbing material 22 further inserting the scrubbing material within the nipple 20 for cleaning and limiting the entry of the rod 11 into the nipple. In this way the inner portion of the nipple 20 including a tip 27 is cleaned.

Figure 4:
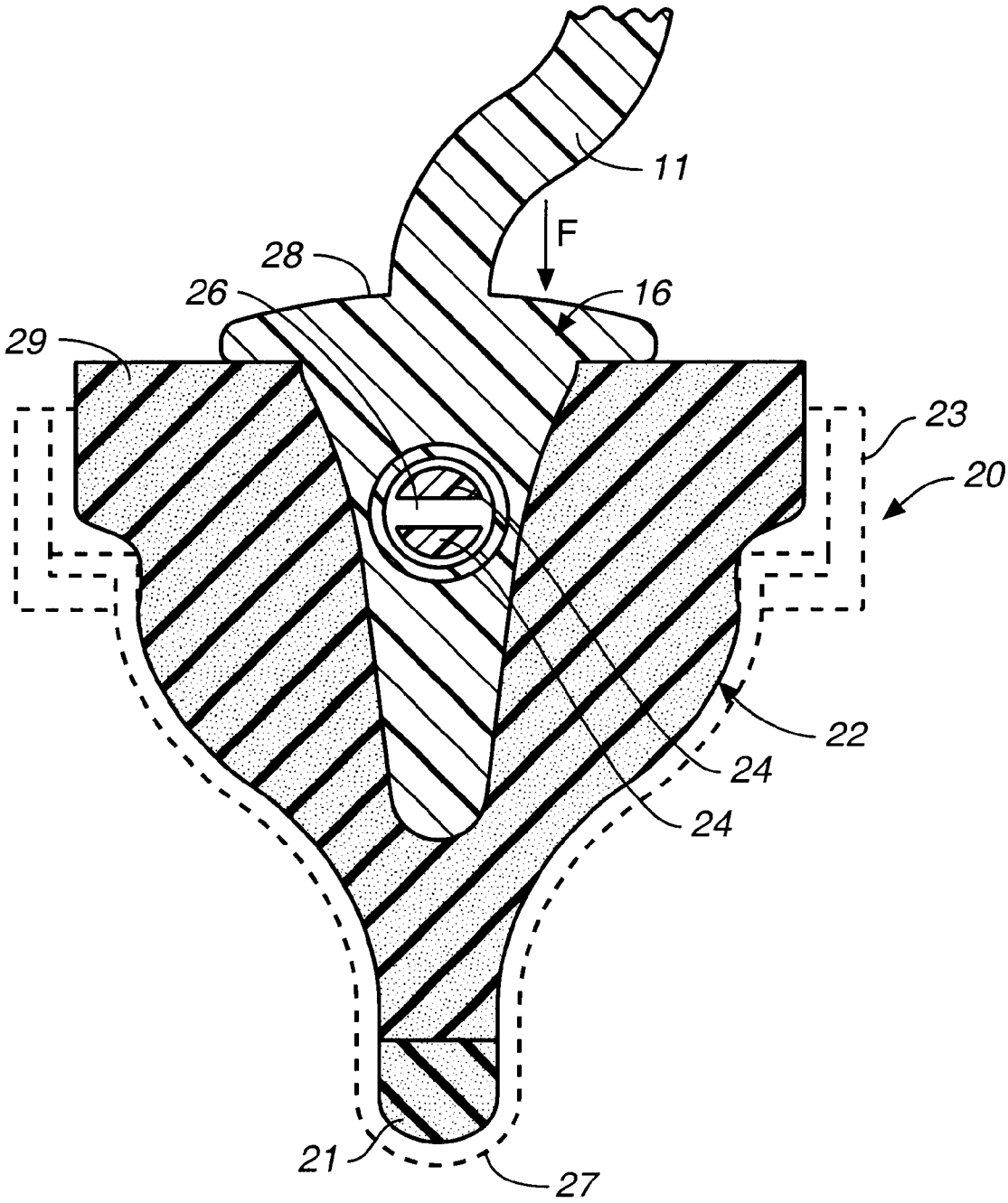
FIG. 4 is a partial cross-sectional view of the invention of FIG. 1.

As seen in FIG. 4, the scrubbing material 22 is conical or nipple-like in shape terminating in a narrow top 21 and a wider bottom 29. Therefore, the tip 27 of the nipple 20 is easily reached for cleaning by the tip 21 of the scrubbing material 22 and the rim 23 of the nipple is easily reached for cleaning by the wider bottom 29 of the scrubbing material 22.

What is claimed is:

1. An apparatus for cleaning baby bottle nipples and the like, comprising:

a handle;

a rod having an offset, the rod rotatably attached to said handle at one end thereof and at a distal end having a clip with first and second tangs having a base and converging to an apex, said convergent tangs securing a scrubbing material therebetween, the convergent tangs and scrubbing material fitting within a baby bottle nipple.

2. The apparatus of claim 1 further defined by a disk affixed to the rod at the base of the tangs limiting the entry of the rod into the nipple.

3. The apparatus of claim 2 wherein a surface of said scrubbing material rests upon said disk, said disk compressing said scrubbing material into said nipple during rotation of said rotatable rod.

4. The apparatus of claim 2 wherein a surface of said scrubbing material rests upon said disk, said disk compressing a tip of said scrubbing material into a tip of said nipple during rotation of said rotatable rod.

5. The apparatus of claim 2 wherein said disk is flat.

6. The apparatus of claim 1 wherein said scrubbing material has a narrow end insertable within a nipple tip.

7. The apparatus of claim 6 wherein said narrow end is an abrasive material.

8. The apparatus of claim 1 wherein said scrubbing material is baby bottle nipple-like in shape.

9. The apparatus of claim 1 wherein said first and second clip tangs are triangular-like in shape.

10. An apparatus for cleaning baby bottle nipples and the like, comprising:

a handle having an opening;

a rod having an offset, said rod rotatably attached to the handle, the rod having one end insertable in said handle opening and having a distal end, a clip with first and second tangs having a base and converging to an apex, one tang insertable in the other and one tang attached to said distal end of said rod, said tangs securing a scrubbing material therebetween, the convergent tangs and scrubbing material fitting within a baby bottle nipple.

11. The apparatus of claim 10 wherein said handle is removably secured to said rod.

12. The apparatus of claim 10 wherein one of said tangs is removably secured to the other of said tangs.

13. The apparatus of claim 10 wherein said scrubbing material is removable from said clip.

14. The apparatus of claim 10 wherein said distal end terminates in a flat support.

15. The apparatus of claim 14 wherein said flat support is a disk.

16. The apparatus of claim 14 wherein one of said tangs is attached to said flat support at said base.

17. The apparatus of claim 10 wherein either of said first and second clip tangs includes a protrusion and the other of said clip tangs includes a cavity, said protrusion insertable into said cavity.

18. The apparatus of claim 17 wherein said scrubbing material has an opening aligned with said cavity of said clip tang and said protrusion is insertable through said scrubbing material opening and said tang cavity, securing said material.

19. The apparatus of claim 10 wherein said rod is S-like in shape.

20. The apparatus of claim 10 wherein said scrubbing material is replaceable.

* * * * *